US005259095A

United States Patent [19]

Tam

[11] Patent Number: 5,259,095

[45] Date of Patent: Nov. 9, 1993

[54] PEN HOLDER

[76] Inventor: Derek S. Y. Tam, Room 1606, Hollywood Plaza, 610 Nathan Road, Kowloon, Hong Kong

[21] Appl. No.: 958,957

[22] Filed: Oct. 9, 1992

[51] Int. Cl.[5] ..... B43K 25/00

[52] U.S. Cl. ..... 24/10 R; 24/3 B; 24/3 F; 24/11 PP

[58] Field of Search ..... 24/3 R, 3 B, 3 E, 3 F, 24/3 M, 10 R, 11 CC, 11 PP, 115 F, 602; 224/202, 245, 249

[56] References Cited

U.S. PATENT DOCUMENTS

| | | | |
|---|---|---|---|
| 169,846 | 11/1875 | Rising | 24/10 R |
| 357,351 | 2/1887 | Welliver | 24/10 R |
| 1,370,452 | 3/1921 | Kane | 24/3 R |
| 1,516,848 | 11/1924 | Edwards et al. | 24/3 L |
| 1,566,195 | 12/1925 | Gandrau | 24/3 E |
| 1,620,930 | 3/1927 | Webb | 24/3 E |
| 4,176,773 | 12/1979 | Wilkinson | 24/3 B X |
| 4,674,298 | 6/1987 | Wimmershoff-Caplan | 24/3 B |
| 5,027,477 | 7/1991 | Seron | 24/3 R X |

*Primary Examiner*—James R. Brittain
*Attorney, Agent, or Firm*—Wallenstein, Wagner & Hattis, Ltd.

[57] ABSTRACT

A holder is disclosed which comprises a body having a cavity with an opening for receiving an object to be held, for example a pen, a spring member is disposed in the cavity and the spring member is deformable by the object inserted into the cavity to hold the object against the wall of the cavity.

12 Claims, 3 Drawing Sheets

PEN HOLDER

BACKGROUND AND FIELD OF THE INVENTION

This invention relates to a holder more particularly but not exclusively to a holder for a pen which may be worn around the neck.

A pen holder having a cord attached for wearing around the neck as an accessory for use with a pen has been proposed. The holder receives and retains the pen, which may be detached for use. It is a disadvantage of such a proposed pen holder as currently available that it is only suitable for use with one particular make of pen. It is a further disadvantage of such a pen holder that, as the cord is worn around the neck, if the holder is accidentally or deliberately pulled away from the wearer, this can result in serious injury to the neck.

It is an object of the invention to provide a holder which alleviates the aforementioned disadvantages.

SUMMARY OF THE INVENTION

According to the invention in a first aspect there is provided a holder comprising a body having a cavity with an opening for receiving an object to be held, spring means disposed in the cavity, the spring means being deformable by a said object inserted into the cavity to hold the object therein.

Preferably the cavity is of elongate form and is adapted to receive a writing implement and the opening may be correspondingly circular. Alternatively, the opening may be of slit shape extending a substantial proportion of the length of the cavity, for receiving a substantially planar object such as a ticket or a credit card.

The spring member is preferably a leaf spring formed from resilient steel.

In a further aspect of the invention, a holder is provided including means for connection to a cord for hanging around the neck, the connection means comprising first and second openings for receiving the ends of the cord, the ends of the cord being of enlarged section so as not to pass through the openings and wherein the sides of the opening are deformable to allow the end of the cord to pass through upon application of a pre-determined force.

BRIEF DESCRIPTION OF THE DRAWINGS

Embodiments of the invention will now be described, by way of example, with reference to the accompanying drawings in which.

DETAILED DESCRIPTION OF THE DRAWINGS

Figure 1:
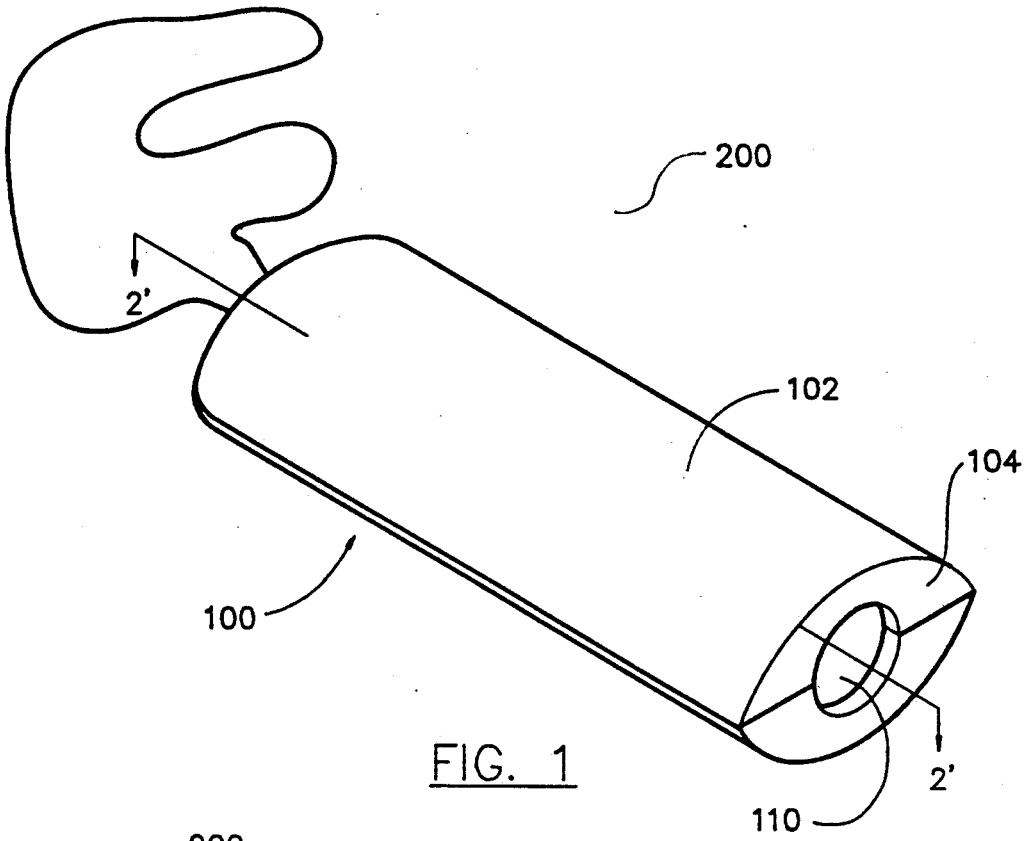
FIG. 1 is a perspective view of the first embodiment of the invention.
Figure 2:
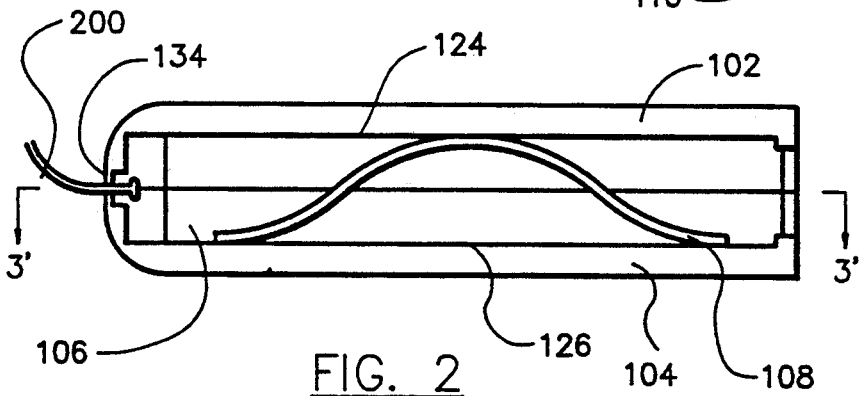
FIG. 2 is a view across the section 2'—2' of FIG. 1.
Figure 3:
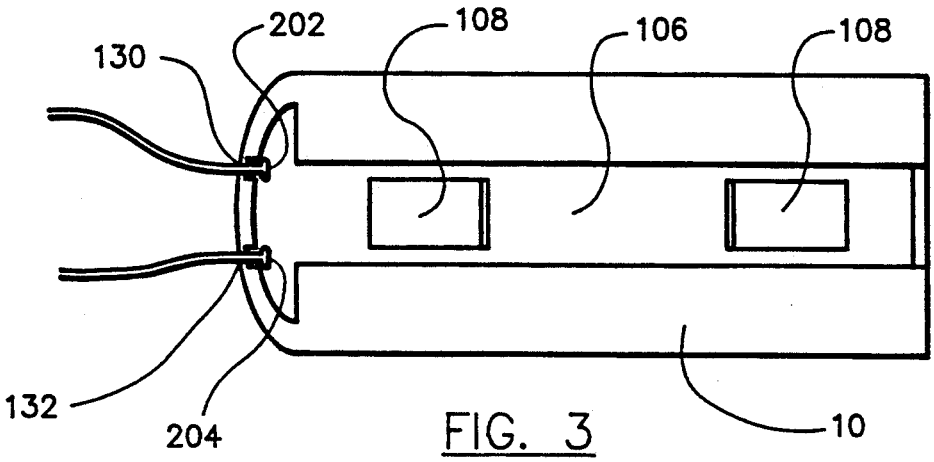
FIG. 3 is a cross sectional view in the plane 3'—3' of FIG. 2.

With reference to the figures, a holder being an embodiment of the invention is shown. The holder comprises a body 100 to which a cord 200 is connected. The body is formed from first and second body members of similar form 102, 104, which are joined together for example by adhesive. The body 100 is provided with an elongate cavity 106 in which a leaf spring 108 formed from resilient steel is disposed. The cavity 106 is provided with a circular opening 110 at one end for receiving, for example, a pencil or other stationery item. The leaf spring 106 is of such form to extend between opposed sides of the cavity, as shown in FIG. 2.

Figure 4:
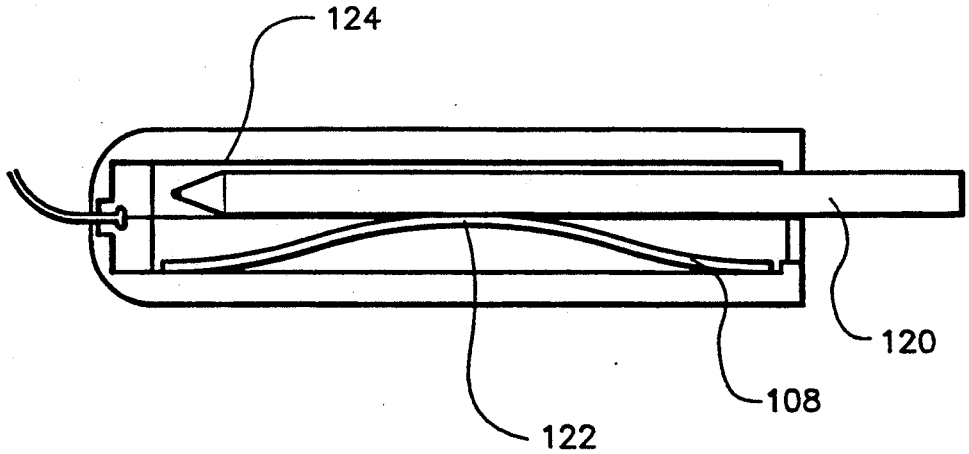
FIG. 4 is a view similar to FIG. 2 showing a writing implement held by the holder.

In use, a pencil or other writing implement 120 may be inserted through opening 110 and will deform leaf spring 108 to a position shown in FIG. 4 so that the pencil 120 is held between the apex 122 of spring 108 and side 124 of the cavity 106. As the spring can adjust to accommodate any width or diameter of a writing implement, the holder may be used for different makes and forms of writing implement and is not restricted simply for use with a single make or brand of pen, for example.

Figure 6:
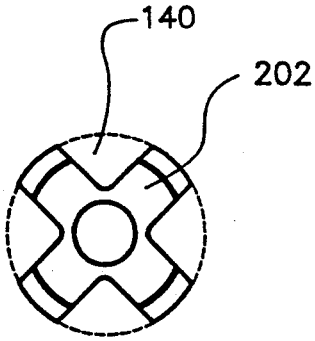
FIG. 6 shows detail of the cord receiving openings of the embodiments of the invention.

The holder further includes means to attach the cord 200 to the body 100. The ends 202, 204 of the cord 200 are formed of enlarged cross section relative to the remainder of the cord, for example by tying of a knot in the end of the cord after passing through openings 130, 132 in the body 100 that the ends of the cord cannot pass through openings 130, 132. Each opening 130, 132 has a ledge 134 of substantially reduced width. The width and diameter of the ledge 134 is such that if a pulling force is applied to the body of a magnitude sufficient to cause injury to the neck of a wearer, the ledge 134 will deform thus releasing the end of the cord 200. Preferably, as shown in FIG. 6, the ledge 134 may comprise four tongues 140.

Figure 5:
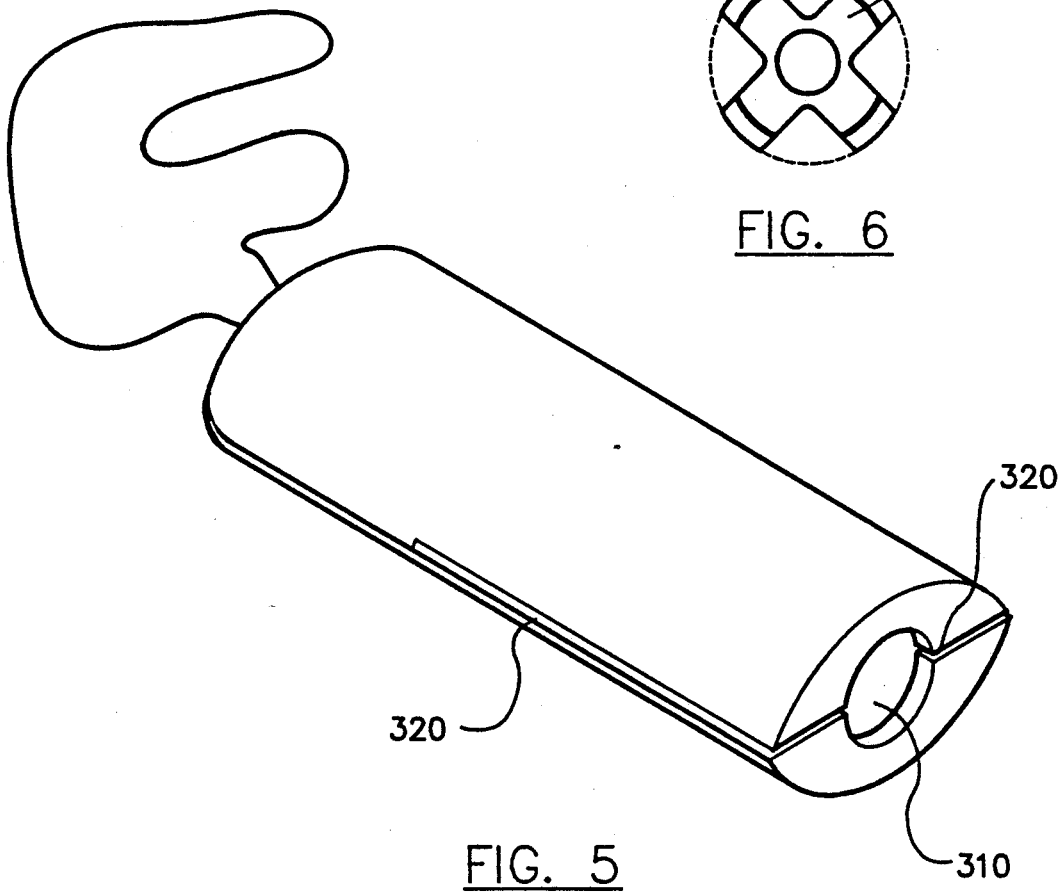
FIG. 5 is a view similar to FIG. 1 showing a second embodiment of the invention.

The first embodiment of the invention illustrates a holder suitable for use with a writing implement. A second embodiment of the invention is shown in FIG. 5 which, in addition to opening 310, an elongate slit 320 is provided along three quarters of the length of the body, thus allowing substantially planar articles such as tickets or credit cards to be held in a similar manner to that shown in FIG. 4.

Figure 7:
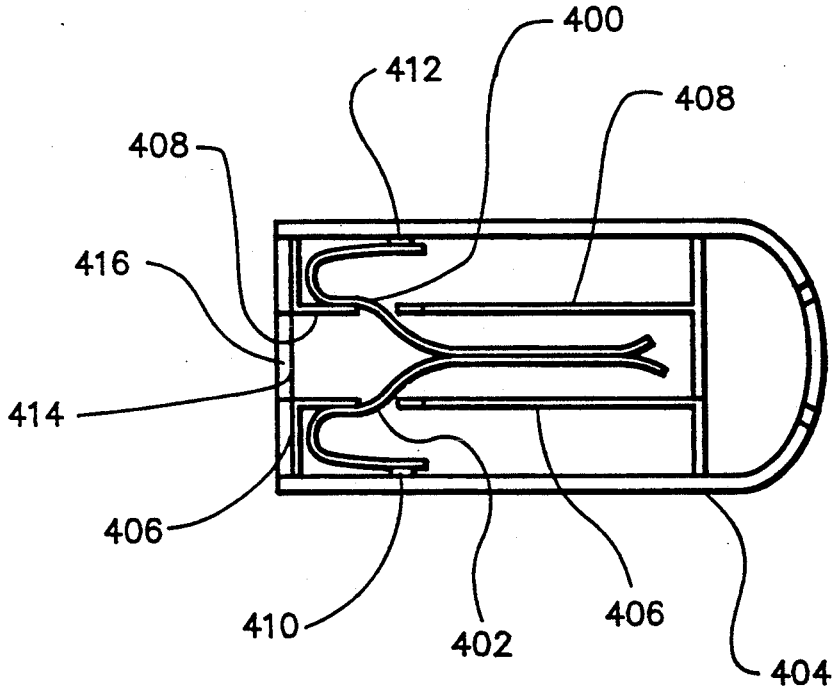
FIG. 7 is a view similar to FIG. 3 shows a third embodiment of the invention.

In FIG. 7, a third embodiment of the invention is shown having a different form of spring means. Instead of providing a single spring member, two mirror-image spring members 400, 402, are held between first and second body members of similar form of which body member 404 is shown. The spring members 400, 402 are retained in place in the body members by means of retaining walls 406, 408 and stop members 410, 412. The spring members 400, 402 mate against one another in cavity 414 so that when a writing implement, for example, is introduced through opening 416, the members 400, 402 are prised apart, holding the writing implement therebetween. In a similar manner to the second embodiment of the invention, an elongate slit may be provided in each of the body members, extending in line with the mating portions of the spring members as illustrated by phantom line 420.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A holder comprising a body having a cavity with an opening for receiving an object to be held, wherein the opening comprises a slit extending a proportion of the length of the cavity, the slit being adapted to receive substantially planar objects into the slit to be held within the cavity, and the holder further comprising spring means disposed in the cavity, the spring means being deformable by the object or the substantially planar objects inserted into the cavity to hold the object or objects therein.

2. A holder as claimed in claim 1 wherein the spring means comprises at least one spring member.

3. A holder as claimed in claim 2 wherein the spring member is a leaf spring.

4. A holder as claimed in claim 1 wherein the spring means holds the object against the inner wall of the cavity, and the body encloses and surrounds the spring means.

5. A holder as claimed in claim 1 wherein the spring means comprises first and second spring members, the first and second spring members being in contact with each other within the cavity prior to insertion of the object through the opening, and the first and second spring members being out of contact with each other after insertion of the object through the opening and where the object is held between the spring members.

6. A holder as claimed in claim 5 wherein the cavity is formed by first and second body members and within the cavity are central retaining walls that oppose each other, such that non-mating portions of the spring members are retained in place by the retaining walls and mating portions of the spring members are disposed between the retaining walls, and further wherein the first and second body members each have an elongates slit extending a proportion of the length of each body member, the slit being parallel to the mating portions of the spring members.

7. A holder as claimed in claim 1 wherein the cavity is of elongate form.

8. A holder as claimed in claim 1 wherein the opening is of circular cross section.

9. A holder as claimed in claim 1 wherein the body comprises first and second body members having opposing walls that form the cavity, the spring means being disposed between the opposing walls of the first and second body members, and further wherein each opposing wall has an elongated slit extending along a proportion of the length of each opposing wall, the slits being adapted to receive substantially planar objects into the slits, and the opposing walls being adapted to support the substantially planar objects.

10. A holder comprising a body having a cavity with an opening for receiving an object to be held; spring means disposed in the cavity, the spring means being deformable by the object inserted into the cavity to hold the object therein; and a cord for hanging around the neck of a user, the cord being connected to the body; wherein the body includes first and second openings for receiving ends of the cord, the ends being of a cross section greater than the openings so as to be retained thereby, and wherein the openings are each provided with deformable ledge means to allow the end of the cord to pass therethrough upon application of a predetermined force.

11. A holder comprising a body having a cavity with an opening for receiving an object to be held; spring means disposed in the cavity, the spring means being deformable by the object inserted into the cavity to hold the object therein; and a cord for hanging around the neck of a user, the cord being connected to the body; wherein the body includes first and second openings for receiving ends of the cord, the ends being of a cross section greater than the openings so as to be retained thereby, and wherein the openings are each provided with deformable ledge means to allow the end of the cord to pass therethrough upon application of a predetermined force, and further wherein the ledge means comprises a plurality of tongues.

12. A holder comprising a body for receiving an object to be held, the body having first and second openings for receiving ends of the cord for wearing around the neck of a user, the ends being of a cross section greater than the openings so as to be retained thereby and wherein the openings are each provided with deformable ledge means to allow the ends of the cord to pass therethrough upon application of a predetermined force.

* * * * *

UNITED STATES PATENT AND TRADEMARK OFFICE

CERTIFICATE OF CORRECTION

PATENT NO. : 5,259,095

DATED : 11/9/93

INVENTOR(S) : Derek S.Y. Tam

It is certified that error appears in the above-identified patent and that said Letters Patent is hereby corrected as shown below:

Column 3, line 40, change "elongates" to --elongated--.

Signed and Sealed this

Nineteenth Day of April, 1994

Bruce Lehman

BRUCE LEHMAN

*Commissioner of Patents and Trademarks*

*Attest:*

*Attesting Officer*